US006132126A

United States Patent [19]

Sheffler et al.

[11] Patent Number: 6,132,126

[45] Date of Patent: Oct. 17, 2000

[54] ADJUSTABLE COSMETIC APPLICATOR

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 09/351,156

[22] Filed: Jul. 12, 1999

[51] Int. Cl.[7] ..... B43K 23/08

[52] U.S. Cl. ..... 401/213; 401/209; 401/6

[58] Field of Search ..... 401/213, 209, 401/183, 184, 185, 208, 153, 6

[56] References Cited

U.S. PATENT DOCUMENTS

| | | | |
|---|---|---|---|
| 4,571,106 | 2/1986 | Scuderi | 401/213 |
| 5,425,591 | 6/1995 | Contreras et al. | 401/153 |
| 5,671,497 | 9/1997 | Abdo | 401/6 |
| 5,897,267 | 4/1999 | Poolman et al. | 401/213 |

*Primary Examiner*—David J. Walczak
*Attorney, Agent, or Firm*—H. Gibner Lehmann; K. Gibner Lehmann

[57] ABSTRACT

A ball-applicator device for applying a cosmetic substance to the skin of a user, has a squeeze container in the form of an upright bottle which is molded of resilient plastic substance. The bottle or container has a relatively broad bottom surface by means of which it can be placed upright on a supporting surface, and has a tubular side wall construction which is adapted to be gripped by and held in the hand for manipulation and squeezing. The side wall construction can have generally the configuration of a pistol grip of mostly cylindrical cross section, being circular at its top. An externally threaded applicator head is disposed on the circular top of the side wall construction of the bottle. The applicator head has a reduced-diameter rim portion constituting an inwardly facing socket, in which a ball applicator member is held captive and exposed to the exterior for engagement with the skin of the user for the purpose of transferring cosmetic substance thereto from the bottle. An upper portion of the bottle is formed with a bellows configuration that is disposed below the top rim of the bottle, for enabling the threaded applicator head and applicator ball to be tilted angularly in various directions with respect to the lower portions of the bottle, thereby to permit the ball applicator member to face in different directions while the bottle is being hand held.

7 Claims, 2 Drawing Sheets

ADJUSTABLE COSMETIC APPLICATOR

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic applicators, more particularly to roll-on devices of this type which are intended to be adjustable so as to facilitate the application of the cosmetic substance to different parts of the body, particularly those which are hard to reach such as areas under the arms, side chest areas, etc.

2. Description of the Related Art Including Information Disclosed Under 37 CFR §§1.97–1.99

The following references are hereby cited as being representative of some of the known prior art in the field to which the present invention pertains:

U.S. Pat. Nos.:

D-248,214 D-264,179 4,359,292 4,571,106 5,851,077

U.S. Pat. No. D-248,214 discloses a ball-type applicator device wherein a hand held container mounts at an angle an externally threaded neck portion which carries an applicator ball that faces away from the vertical axis of the container at approximately a 45 degree angle. There is no adjustability of the device, and the user is required to change his or her grip on the container if the direction or facing of the ball is to be altered. This could be awkward, and if such operation is carried out there is a possibility of the device slipping from the user's grasp.

U.S. Pat. No. 264,179 is also a non-adjustable ball-type cosmetic applicator. The container in this patent has somewhat the shape of a boot, with a threaded neck portion disposed below a smooth neck extension that carries the ball. Presumably this patentee also intended to use the angular shape of the body to facilitate application of the ball element to hard-to-reach areas of the body, such as under the arms, behind the shoulders, etc. The drawback pointed out above in connection with the first-mentioned patent exists virtually to the same degree with this device, in that the user is required to change his grip on the device in order to effect different orientations of the ball.

In U.S. Pat. No. 4,359,292 a rounded applicator element somewhat in the shape of a ball is utilized in various embodiments, ostensibly to obtain an adjustment function. This patent has a number of interfitting components which require close tolerances, resulting in costly tooling, assembly and interfitting of the parts. Even so, the amount of adjustability is limited to small angles of the applicator element.

U.S. Pat. No. 4,571,106 discloses a ball-type applicator wherein the container is somewhat in the shape of a banana, with the applicator element disposed at one end thereof. Presumably this gives the user an advantage in the handling of the device, enabling it to reach inaccessible locations such as under the arms, etc. The ball element is not adjustable with respect to the container, but instead remains at a fixed location, and the user is required to do all of the manipulation by changing his or her grip on the handle or container.

U.S. Pat. No. 5,851,077 addresses the problem of adjustability of the applicator element by the provision of a bellows configuration which joins the container of the cosmetic substance to the applicator head. A ball-type applicator element is carried by the applicator head to enable the ball element to be faced in different directions. The container is elongate and curved, and not adaptable to convenient space saving in storage or on the shelf in a retail outlet.

The above drawbacks and disadvantages of prior ball-type cosmetic applicators are obviated by the present invention, and one object of the invention is to provide a novel and improved ball-type cosmetic applicator of the class above mentioned, which is especially simple and economical in construction while at the same time being space-saving on the shelf and providing for easy and convenient adjustability of the applicator head.

Another object of the invention is to provide an improved adjustable-head cosmetic applicator in accordance with the foregoing, which has few, readily moldable plastic components that can be quickly assembled, thereby making for a low manufacturing cost.

A further object of the invention is to provide an improved cosmetic applicator of the adjustable type in accordance with the above, wherein one-hand adjustment of the device is possible when it is being applied by said hand to the various areas of the body.

A feature of the invention is the provision of an improved adjustable ball-type cosmetic as set forth above, wherein the bellows portion of the container enables the applicator head to be aligned with the axis of the bottle whereby the horizontal dimensions of the device are greatly reduced to permit a multiplicity of like devices to be stored side by side either in boxes or else on shelves in the retail outlet.

In accomplishing the above objects the invention provides a unique molded plastic construction involving but few components which can be formed in simple molds, some components being flexible or resilient and others being relatively rigid or stiff. A main component of the construction consists of a flexible squeeze container in the form of an upright bottle of one-piece construction which is molded of resilient plastic substance, said bottle having a relatively broad bottom surface by means of which it can be placed upright on a supporting shelf surface or table top. The bottle has a tubular side wall configuration which is adapted to be gripped by the hand of the user for manipulation and squeezing, being generally shaped somewhat like a pistol grip but having upper portions of cylindrical cross section. At its top the bottle comprises an externally threaded applicator portion or head which joins the circular top of the side wall construction of the bottle, said applicator portion having a reduced-diameter rim which constitutes an inwardly facing socket in which a ball applicator member or element is held captive. The ball element is exposed to the exterior for engagement with the skin of the user thereby to enable transfer of cosmetic substance thereto from the bottle. The bottle side walls in upper portions thereof have means comprising a bellows configuration disposed below the said circular top portion thereof, for enabling the threaded applicator head and circular top to be tilted angularly in various directions with respect to the lower portions of the bottle, thereby to permit the ball applicator member to face in different directions while the bottle is being hand held.

Other features and advantages will hereinafter appear.

Figure 1:
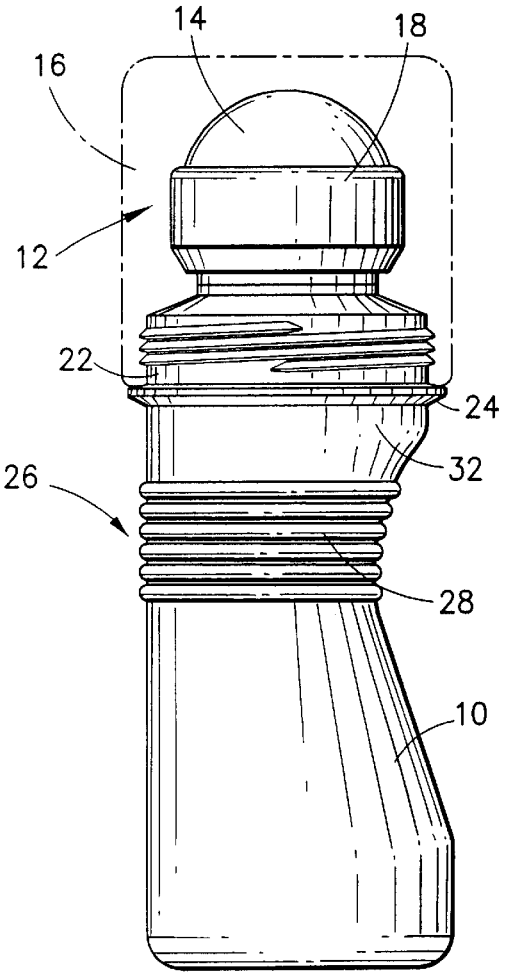
FIG. 1 is a side elevational view of the improved adjustable cosmetic applicator of the invention shown in the storage position of the applicator element.
Figure 2:
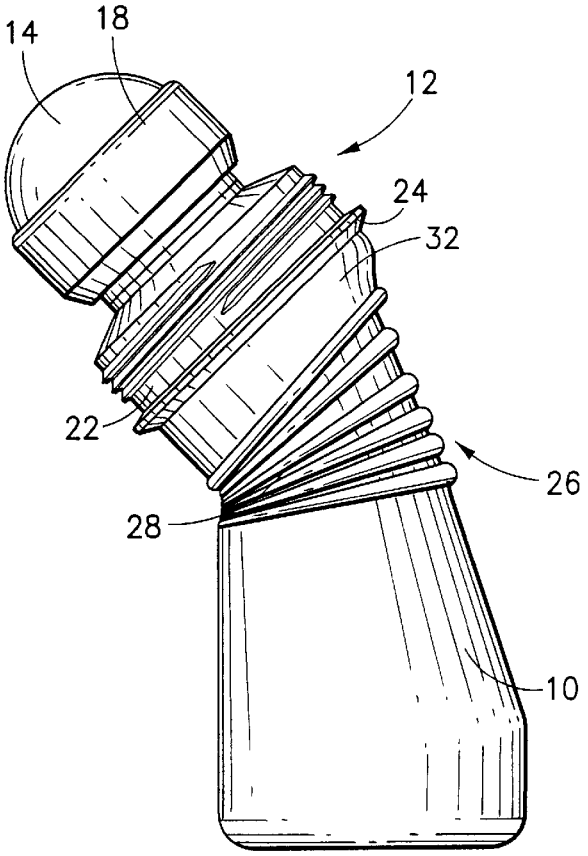
FIG. 2 is also a side elevational view of the applicator device of FIG. 1, shown with the cover piece or screw cap removed and with the applicator head in an operative, angularly-adjusted position such as might be employed for reaching under the arm areas of a person's body.

Referring first to FIGS. 1 and 2, the adjustable cosmetic applicator of the invention comprises basically a container or bottle component 10 which includes an accordian-fold type adjustment means, an integral applicator head 12 which is part of the container 10 and which includes an applicator ball or element 14, and a cover piece or screw cap 16 which has internal threads 17 and which is attachable to and removable from the applicator head 12.

Figure 3:
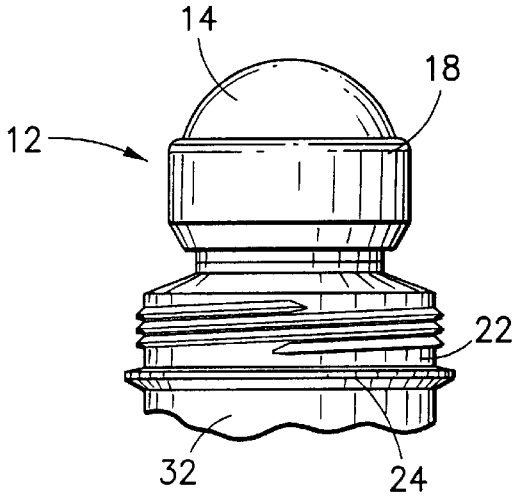
FIG. 3 is a side elevational view of the upper applicator portion of the device, per se.
Figure 4:
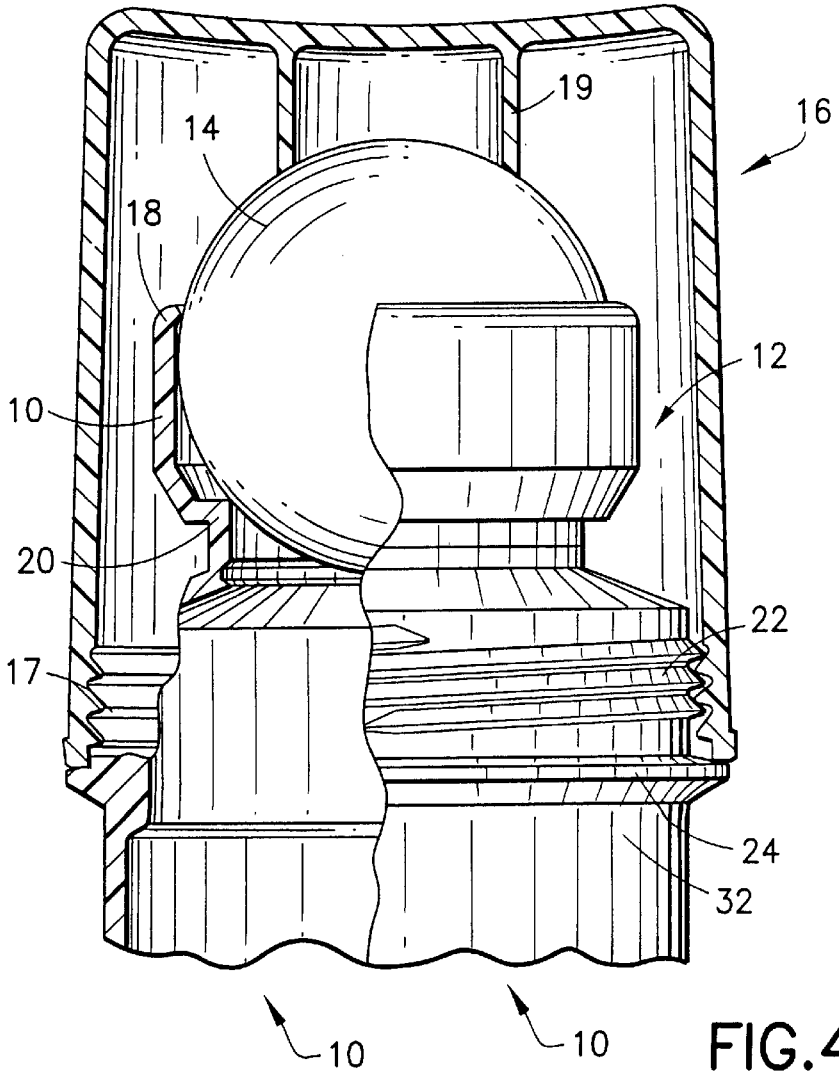
FIG. 4 is an enlarged detail of the upper applicator portions of the device, being in part side elevation and in part axial section and showing a fragmentary upper portion of the container.

Referring to FIGS. 3 and 4, the applicator head portion 12 comprises a short cylinder having a top rim 18 which is inturned slightly so as to form a socket for the ball 14, such socket holding the ball captive in the head 12. The inside diameter of the head 12 is large enough to enable the ball 14 to turn easily therein, and a circular bearing seat 20 is provided in the head to cradle the ball 14 at its bottom for rotation. The bearing seat or shoulder 20 is a seal and is formed by a reduced-diameter portion of the applicator head, as is clearly shown in FIGS. 3 and 4. The ball 14 is normally retained tightly in the seat 20 by a depending flange or cup 19 of the screw cap 16, when the latter is tightened.

The lower portion 22 of the applicator head 12 is of larger diameter than the rest of the head, and has double-lead external threads of 0.167 pitch to make for quick and easy removal of the screw cap 16. The external threads of the head 12 mate with similar-pitch internal threads of the cap 16, as will be understood. The cap 16 has a cup 19 which presses the ball 14 into sealing engagement with the seat 20 to close the bottle 10.

The upper portion of the bottle that is just below the applicator head 12 has an annular external flange 24 which is adapted to be engaged by the bottom rim or edge of the screw cap 16, as shown in FIG. 1.

In accordance with the present invention the container or bottle 10 is formed in a unique manner to provide an improved hand grip and adjustability means by which the applicator device can be easily manipulated when being held in one hand, to readily position the ball 14 for application of the cosmetic thereon to difficult-to-reach areas of the body, as for example under the arm areas and also back areas. In accomplishing this, the intermediate bottle portions designated generally by the arrows 26 are preferably formed so as to have cylindrical sections, and such portions are also formed to have the configuration of a bellows or accordian like fold 28 whereby an angularity can be given to the applicator head portion 12 with its accompanying ball 14, all as shown in FIG. 2.

This angularity can be readily adjusted with the device being held with the one hand in the manner of a handle, and also as the cosmetic substance is being applied to the user's skin in hard-to-reach areas.

The container 10 with its applicator head portion 12, ball applicator element 14 and closure cap 16 are all capable of being produced by known plastic molding techniques, and various formulations of plastics can be chosen for these various components, according to the characteristics that are desired.

Preferably the container 10 from its bottom wall comprises a short, upwardly-extending cylindrical portion which joins to a main body portion that is of conical configuration. The main body portion of conical configuration joins to the fold 28 which is generally conical, with its larger diameter folds being at its top. Above the fold 28 is an additional conical portion flaring upward, which joins to a smooth walled portion 32 of cylindrical configuration. The portion 32 and portions below it to the bottom of the bottle generally form the total bottle configuration.

In the cosmetic applicator of the present invention, the applicator head and the top of the side wall construction of the bottle are resettable between tilted positions out of the vertical to a true vertical position wherein the entire device can be placed side by side with other similar devices to effect a saving of shelf space.

As shown, the bellows configuration, in its general outline, defines a substantially conical configuration.

Additionally, the portion of the handle that is located above the bellows configuration is on average of greater diameter than the bellows configuration and is adapted to fit the hand of the user between the thumb and forefinger thereof.

The above construction is seen to have the advantage of very few components, there being basically the container 10 with the integral applicator head 12 and the applicator ball 14, together with the screw cap or cover piece 16. The entire container 10 can be molded in various known ways, as will be understood.

The control of discharge of the cosmetic substance from the container 10 is readily had, by merely squeezing the container by the amount needed, and in conjunction with this the desired adjustment as to the direction in which the ball 14 faces is had by either turning the container or else by applying pressure to the side of the applicator head portion 12, or both as the device is being put to use.

The present cosmetic applicator is small and compact, requiring little shelf space, and is readily convenient and adaptable to use in crowded environments, as can now be understood.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

LISTING OF THE NUMERALS

10. Container or bottle
12. Applicator head portion of container
14. Applicator ball
16. Screw cap
17. Screw threads of screw cap
18. Top rim of applicator head portion of bottle
19. Depending flange or cup
20. Internal bearing seat or shoulder of applicator head portion
22. Lower portion of applicator head portion of bottle
24. External flange of applicator head portion of bottle
26. Intermediate bottle portions
28. Accordian or bellows configurated portion of bottle
32. Upper smooth-walled conical side portion of bottle

What is claimed is:

1. A device for applying a cosmetic substance to the skin of a user, comprising in combination:

a) a squeeze container in the form of an upright bottle which is molded of resilient plastic substance, b) said bottle having a relatively broad bottom surface by means of which it can be placed upright on a supporting surface, c) said bottle having a tubular side wall construction which is adapted to be gripped by the hand in the manner of a handle, for manipulation and squeezing, d) said side wall construction having generally the configuration of a pistol grip of cylindrical cross section, e) said side wall construction at its top being circular, f) an externally threaded applicator head on the circular top of the side wall construction of the bottle, g) said applicator head having a reduced diameter rim portion constituting an inwardly facing socket, h) a ball applicator member which is held captive in said socket and which is exposed to the exterior and adapted to engage the skin of the user for the purpose of transferring cosmetic substance thereto from the bottle, and i) said bottle side wall construction in an upper portion thereof having means comprising a bellows configuration disposed below the said circular top thereof, for enabling the threaded orifice member and circular top to be tilted angularly in various directions with respect to the lower portions of the bottle, thereby to permit the ball applicator member to face in different directions while the bottle is being hand held.

2. A device for applying a cosmetic substance to the skin of a user as set forth in claim 1, wherein:

a) said applicator head and said top of the side wall construction of the bottle are resettable between tilted positions out of the vertical to a true vertical position wherein the entire device can be placed side by side with other similar devices to effect a saving of shelf space.

3. A device for applying a cosmetic substance to the skin of a user as set forth in claim 1, and further including:

a) a screw cap having internal threads enabling it to be screwed onto said applicator head, b) said applicator head having a bottom rim and shoulder disposed at its bottom rim for engagement with the bottom edge of said screw cap.

4. A device for applying a cosmetic substance to the skin of a user as set forth in claim 1, wherein said bellows configuration, in its outline, defines a substantially conical configuration.

5. A device for applying a cosmetic substance to the skin of a user as set forth in claim 1, wherein:

a) the bottle has a smooth enlarged diameter portion above the bellows configuration, b) said enlarged diameter portion, bellows configuration and lower portions of the bottle being in the nature of a pistol grip that can be easily grasped by the hand of the user, enabling the device to be readily manipulated.

6. A device for applying a cosmetic substance to the skin of a user as set forth in claim 5, wherein the portion of the container that is located above the bellows configuration is on average of greater diameter than the bellows configuration and is adapted to fit the hand of the user.

7. A device for applying a cosmetic substance to the skin of a user as set forth in claim 1, wherein the externally threaded applicator head has a conical portion above the external screw threads thereof, said conical portion terminating in an internal bearing for the ball applicator.

* * * * *